US008126357B2

(12) United States Patent
Satomura

(10) Patent No.: US 8,126,357 B2
(45) Date of Patent: Feb. 28, 2012

(54) PROCESS CARTRIDGE WITH SHEET MEMBER CONTACTING PHOTOSENSITIVE MEMBER

(75) Inventor: Shogo Satomura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 12/470,133

(22) Filed: May 21, 2009

(65) Prior Publication Data

US 2009/0297213 A1 Dec. 3, 2009

(30) Foreign Application Priority Data

May 27, 2008 (JP) ..... 2008-138248

(51) Int. Cl.
*G03G 21/18* (2006.01)

(52) U.S. Cl. ..... 399/111

(58) Field of Classification Search ..... 399/111, 399/112, 113, 119, 120
See application file for complete search history.

(56) References Cited

U.S. PATENT DOCUMENTS

2005/0069342 A1* 3/2005 Kanno et al. ..... 399/111
2008/0008497 A1* 1/2008 Kato et al. ..... 399/113
2008/0138109 A1* 6/2008 Anan et al. ..... 399/113
2009/0297211 A1* 12/2009 Kanno et al. ..... 399/111

FOREIGN PATENT DOCUMENTS

JP 5-053434 A 3/1993
JP 7-295457 A 11/1995

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

A process cartridge is configured to perform a contact and separation operation between a developing roller and a photosensitive drum. The process cartridge is provided with a toner scattering prevention sheet. The process cartridge includes a container a part of which is provided with a contact portion for regulating a spacing range between the developing roller and the photosensitive drum.

7 Claims, 5 Drawing Sheets

PROCESS CARTRIDGE WITH SHEET MEMBER CONTACTING PHOTOSENSITIVE MEMBER

FIELD OF THE INVENTION AND RELATED ART

The present invention relates to a process cartridge for use with an electrophotographic image forming apparatus.

Here, an electrophotographic image forming apparatus refers to an apparatus which forms an image on recording material (medium) with the use of electrophotographic image forming method. As the example of the image forming apparatus, an electrophotographic copying machine, an electrophotographic printer (for example, laser beam printer, LED printer, etc.), a facsimile machine, a wordprocessor, a multifunction machine (printer) of these machines, etc., may be included.

Further, the process cartridge refers to a cartridge in which at least a developing means as a process means and an electrophotographic photosensitive member are integrally supported, and which is detachably mountable to the main assembly of an electrophotographic image forming apparatus.

In the image forming apparatus, the electrophotographic photosensitive member (drum) is irradiated with light emitted from a laser, an LED, a lamp, or the like, corresponding to image information. As a result, an electrostatic latent image is formed on the photosensitive drum. The electrostatic latent image is developed by a developing device. Then, the developed (electrostatic latent) image on the photosensitive drum is transferred onto the recording material. As a result, an image is formed on the recording material.

As the process cartridge, there is a cartridge constituted by integrally connecting a developing unit and a photosensitive member unit.

In a process cartridge system widely used in the image forming apparatus, such a developing method in which an amount of developer is regulated by bringing a developer regulation member into contact with a developer carrying member is employed. An example thereof will be described with reference to FIG. 6.

Referring to FIG. 6, developer contained in a container is supplied onto a developing roller 25 as a developer carrying member by a toner supplying roller 34 as a developer supplying member. The developer supplied onto the developing roller 25 is regulated by a developing blade 35 as a developer regulating member and then is conveyed into a contact area between the developing roller 25 and a photosensitive drum 1, so that an electrostatic latent image on the photosensitive drum 1 is visualized.

In such a developing device that the developing roller 25 and the developing blade 35 contact each other, there was a possibility that the developer scatters from the contact portion between the developing roller 25 and the developing blade 35, thereby to contaminate the inside of the image forming apparatus.

For that reason, a developing device provided with a scattered developer containing portion for receiving the scattered developer from the developing blade has been proposed (Japanese Laid-Open Application (JP-A) Hei 5-53434). To this scattered developer containing portion, in order to prevent scattering of the developer with reliability, an insulating sheet member which is fixed to a lower edge of a toner inlet of the scattered developer containing portion at one end thereof and contacts a photosensitive member at the other end thereof.

Further, JP-A Hei 7-295457 has proposed a process cartridge in which the developing roller 25 performs a contact and separation operation with respect to the photosensitive drum 1.

SUMMARY OF THE INVENTION

A principal object of the present invention is to provide a constitution capable of suppressing scattering of developer even in the case where a contact and separation operation is performed between a developing roller and an electrophotographic photosensitive member.

Another object of the present invention is to provide a process cartridge having the above constitution.

According to an aspect of the present invention, there is provided a process cartridge detachably mountable to a main assembly of an image forming apparatus, comprising:

a photosensitive member unit including an electrophotographic photosensitive member; and a developing unit including a developing roller for carrying developer so as to develop a latent image formed on the electrophotographic photosensitive member and a sheet member which contacts the electrophotographic photosensitive member at one lateral end thereof and is fixed to the developing unit at the other lateral end thereof, the developing unit being swingable with respect to the photosensitive member unit so as to establish contact and separation between the developing roller and the electrophotographic photosensitive member, wherein when the developing roller is separated from the electrophotographic photosensitive member, a first contact portion provided to the developing unit and a second contact portion provided to the photosensitive member unit contact each other so as to regulate separation of the sheet member from the electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Hereinafter, the process cartridge (hereinafter referred to simply as cartridge) and electrophotographic color image forming apparatus (hereinafter referred to simply as image forming apparatus), in Embodiment 1 of the present invention will be described with reference to the drawings. The cartridge is detachably mountable to a main assembly of the image forming apparatus.

(General Structure of Image Forming Apparatus)

Figure 1:
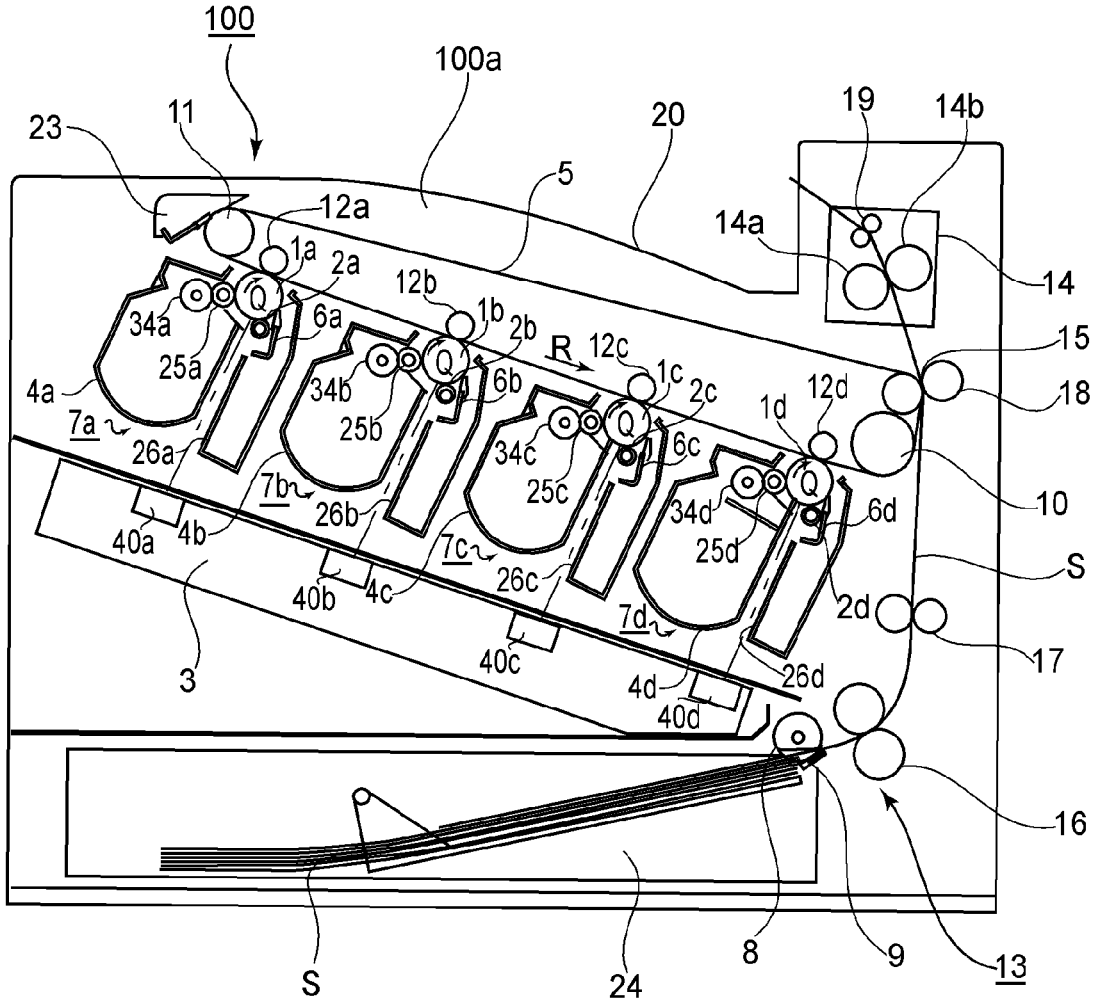
FIG. 1 is a schematic view showing general arrangement of a color electrophotographic image forming apparatus in an embodiment of the present invention.
Figure 5:
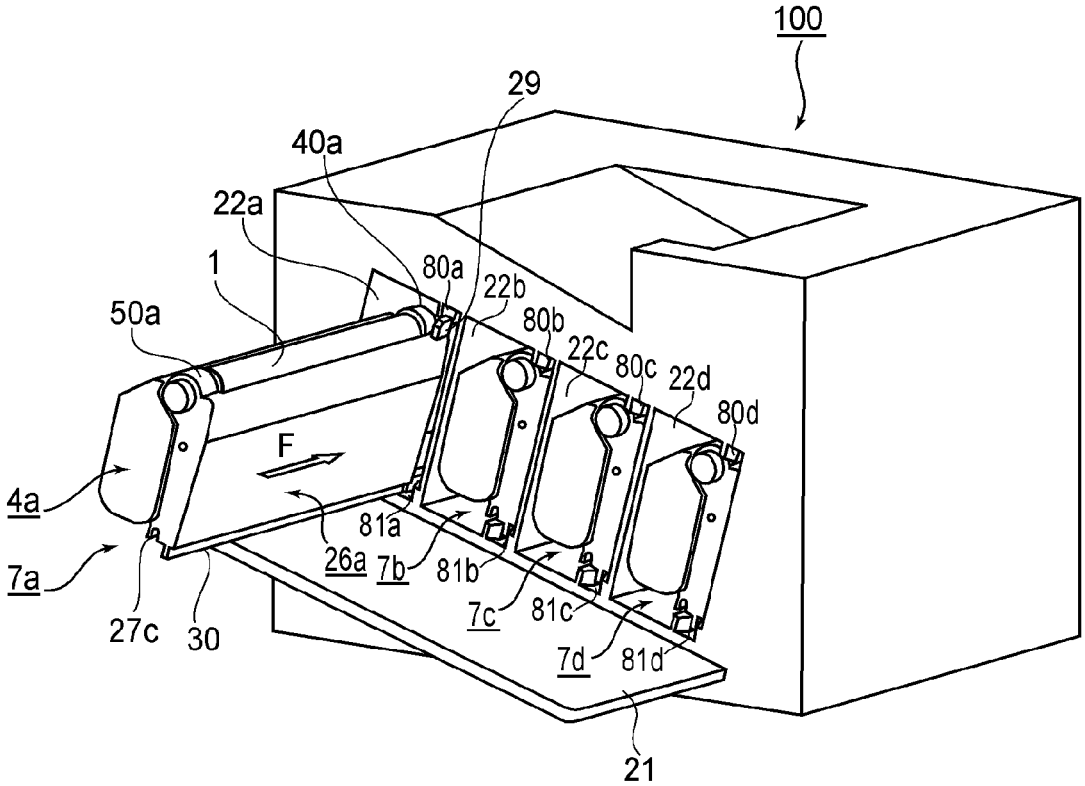
FIG. 5 is a schematic perspective view for illustrating a state of the cartridge before the cartridge is mounted to a main assembly of the image forming apparatus.
Figure 6:
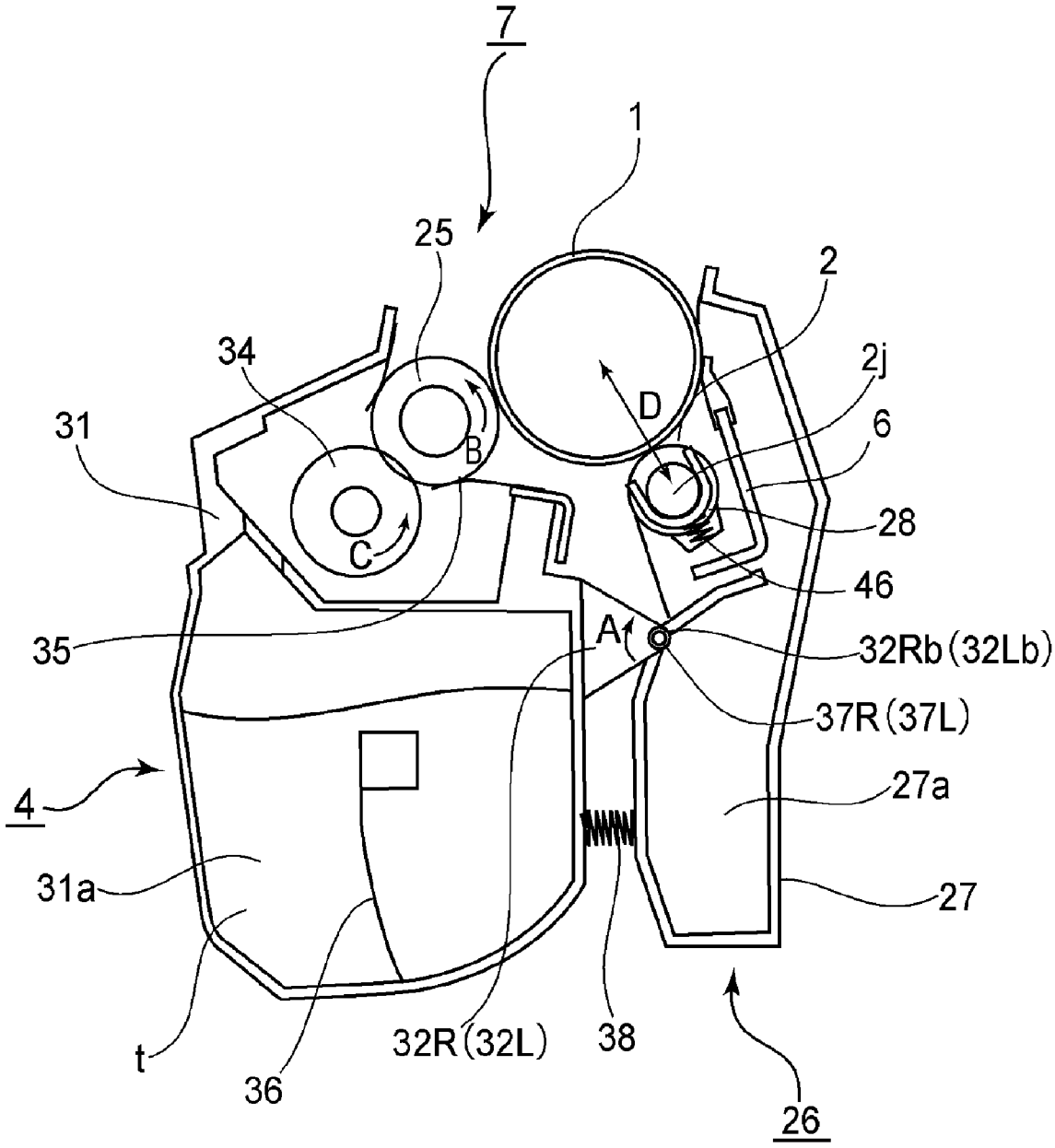
FIG. 6 is a schematic sectional view of a cartridge.

First, referring to FIG. 1, the general structure of the image forming apparatus will be described. The image forming apparatus 100 shown in FIG. 1 has four mounting portions 22 (22*a*-22*d*) (FIG. 5) as mounting means for four cartridge, which are juxtaposed in tandem, in a straight line which is slanted relative to the horizontal direction. The cartridge 7 (7*a*-7*d*), which are mounted into the mounting portions 22, are provided with electrophotographic photosensitive drums 1 (1*a*, 1*b*, 1*c* and 1*d*), respectively.

The abovementioned electrophotographic photosensitive drum (hereinafter referred to as photosensitive drum) 1 is rotationally driven in the direction indicated by an arrow Q in the figure by a driving member (unshown). Around the photosensitive drum 1, the following process means acting on the photosensitive drum 1 are disposed along its rotational direction in the order of a cleaning member 6 (6*a*, 6*b*, 6*c*, or 6*d*) for removing developer remaining on the photosensitive drum 1 surface after transfer (hereinafter referred to as toner); a charge roller 2 (2*a*, 2*b*, 2*c*, or 2*d*) for uniformly charging the surface of the photosensitive drum 1; a developing unit 4 (4*a*, 4*b*, 4*c*, or 4*d*) for developing an electrostatic latent image with the toner; a scanner unit 3, provided with exposure portion 40 (40*a* to 40*d*), for forming the electrostatic latent image on the surface of the photosensitive drum 1 by irradiation with a laser beam on the basis of image information; and an intermediary transfer belt 5 onto which four toner images formed on the photosensitive drums 1 are collectively transferred. The photosensitive drum 1, the cleaning member 6, the charge roller 2, and the developing unit 4 are integrally supported to constitute a cartridge 7. The cartridge 7 is detachably mountable to a main assembly 100*a* of the image forming apparatus 100 by a user.

The intermediary transfer belt 5 is stretched around a driving roller 10 and a tension roller 11. Inside the intermediary transfer belt 5, four primary transfer rollers 12 (12*a*-12*d*) are disposed oppositely to the photosensitive drums 1 (1*a*-1*d*). To the intermediary transfer belt 5, a transfer bias is applied by a bias applying means (unshown).

A toner image formed on each of the surface of the photosensitive drum 1 is successively primary-transferred onto the intermediary transfer belt 5 by rotation of the photosensitive drum 1 in the direction indicated by the arrow Q, rotation of the intermediary transfer belt 5 in the direction indicated by an arrow R, and by application of a positive bias to the primary transfer roller 12. Then, the four toner images in a superposed state on the intermediary transfer belt 5 are conveyed to the secondary transfer portion 15.

In synchronism with the above-mentioned image forming operation, a sheet S as the recording material is conveyed by a conveying means consisting of a sheet feeding device 13, a pair of registration rollers 17, etc. The sheet feeding device 13 has a sheet feeding cassette 24 for accommodating the sheet S, a sheet feeding roller 8 for feeding the sheet S, and a pair of sheet conveying rollers 16 for conveying the fed sheet S. The sheet feeder cassette 24 can be pulled out of the apparatus main assembly 100*a* in the frontward direction in FIG. 1. The sheet S is pressed against the sheet feeding roller 8 and is separated one by one by a separation pad 9 (one-side friction sheet separating method), thus being conveyed.

The sheet S conveyed from the sheet feeding device 13 is conveyed to the secondary transfer portion 15 by the pair of registration rollers 17. At the secondary transfer portion 15, the positive bias is applied to the secondary transfer roller 18. As a result, the four toner images on the intermediary transfer belt 5 are secondary-transferred onto the conveyed sheet S.

A fixing portion 14 as a fixing means fixes the toner images on the conveyed sheet S by applying heat and pressure to the toner images formed on the sheet S. A fixing belt 14*a* is cylindrical and is guided by a belt guiding member (unshown) to which a heat generating means, such as a heater is bonded. The fixing belt 14*a* and the pressing roller 14*b*, form a fixing nip with a predetermined press-contact force.

The sheet S on which the unfixed toner images conveyed from the image forming portions is heated and pressed in the fixing nip. As a result, the unfixed toner images on the sheet S is fixed on the sheet S. Thereafter, the sheet S on which the toner images are fixed is discharged on a sheet discharge tray 20 by a pair of sheet discharge rollers 19.

The toner remaining on the surface of the photosensitive drum 1 after the toner image transfer is removed by the cleaning member 6. The removed toner is collected in a removed toner chamber in the photosensitive member unit 26 (26*a*-26*d*).

The toner remaining on the intermediary transfer belt 5 after the second transfer onto the sheet S is removed by a transfer belt cleaning device 23. The removed toner is conveyed through a waste toner conveyance passage (unshown), and is collected in a waste toner collecting container (unshown) located in the rear end portion of the apparatus.

(Cartridge)

Figure 2:
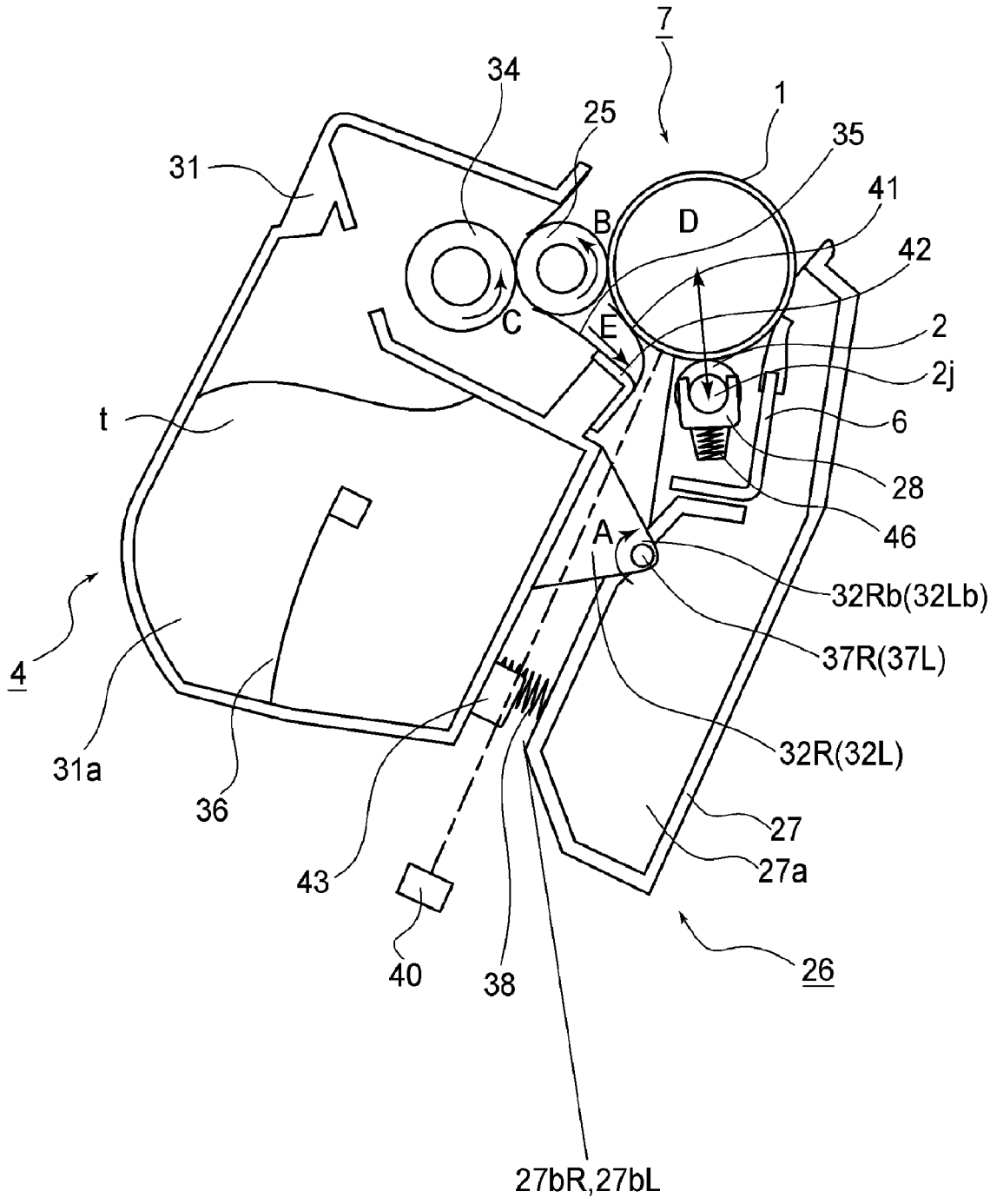
FIG. 2 is a schematic sectional view of a cartridge during image formation.

Next, referring to FIG. 2, the cartridge in this embodiment will be described. FIG. 2 is a principal sectional view of the cartridge 7 containing toner t. Incidentally, the cartridges 7*a*, 7*b*, 7*c*, and 7*d*, which contain yellow, magenta, cyan, and black toners t, respectively, are the same in structure.

Each cartridge 7 is separated into a photosensitive member unit 26 and a developing unit 4. The photosensitive member unit 26 includes the photosensitive drum 1, charge roller 2 (charging means), and cleaning member 6 (cleaning means). The developing unit 4 includes a developing roller 25 (developing means). The photosensitive drum 1 is rotatably supported by a cleaning device frame 27 of the photosensitive member unit 26. The photosensitive drum 1 is rotationally driven correspondingly to the image forming operation by transmitting the driving force from a motor (unshown) to the photosensitive member unit 26.

The charge roller 2 and the cleaning member 6 are disposed on the peripheral surface of the photosensitive drum 1 as described previously. The residual toner removed from the surface of the photosensitive drum 1 by the cleaning member 6 falls into the removed toner chamber 27*a*. The cleaning device frame 27 is fitted with a pair of charging roller bearings 28, which are movable in the direction indicated by an arrow D, which passes through the centers of the charging roller 2 and the photosensitive drum 1. A shaft 2*j* of the charge roller 2 is rotatably supported by the pair of charging roller bearings 28. Further, the bearings 28 are kept pressed toward the photosensitive drum 1 by a charge roller pressing member 49.

The developing unit 4 has the developing roller 24 25 which carries thereon toner t and rotates in contact with the photosensitive drum 1 in the direction indicated by an arrow B, and has a developing device frame 31. The developing roller 25 is rotatably supported by the developing device frame 31 through shaft supporting member 32 (32R, 32L) attached to both longitudinal sides of the developing device frame 31. On the peripheral surface of the developing roller 25, a toner supplying roller 34 rotatable in contact with the developing roller 25 in the direction indicated by an arrow C, and a developing blade 35 for regulating in thickness the toner layer on the developing roller 25. Further, to a toner containing portion 31*a* of the developing device frame 31, a toner conveying member 36 conveying the contained toner to the toner supplying roller 34 while stirring the toner is provided. The developing unit 4 is rotatably (swingably) connected to the photosensitive member unit 26 about swing shafts 37 (37R and 37L) engageable with holes 32Rb and 32Lb provided in the shaft supporting members 32Rb and 32Lb. The developing unit 4 is urged by urging spring 38. Thus, during the image formation, the developing unit 4 rotates about the swing shafts 37 in the direction indicated by an arrow A, so that the developing roller 25 is in contact with the photosensitive drum 1. The toner on the developing roller 25 regulated by the developing roller 25 is conveyed into a contact area between the developing roller 25 and the photosensitive drum 1, and the electrostatic latent image formed on the photosensitive drum 1 is visualized by the exposure portion 40.

An operation in the contact state between the photosensitive drum 1 and the developing roller 25 will be described with reference to FIG. 2.

In this state, the developing blade 35 is supported by a supporting metal plate 42 fixed to a developing container. To this supporting metal plate 42, a toner scattering preventing sheet member 41 for preventing the developer from scattering from the developing roller 25 is provided. The sheet member 41 contacts the surface of the photosensitive drum 1 in its entire longitudinal area at one lateral end thereof and is fixed to the supporting metal plate 42 at the other lateral end thereof.

In this state, in the case where the toner leaks out of the contact surface between the developing roller 25 and the developing blade 35, the toner falls down in the direction indicated by an arrow E by free fall. In this case, a gap between the supporting metal plate 42 and the photosensitive drum 1 is sealed by the sheet member 41, so that it is possible to prevent the leaked toner from scattering in the image forming apparatus.

Next, an operation in a state in which the photosensitive drum 1 and the developing roller 25 are separated from each other will be described with reference to FIGS. 3 and 4.

Figure 3:
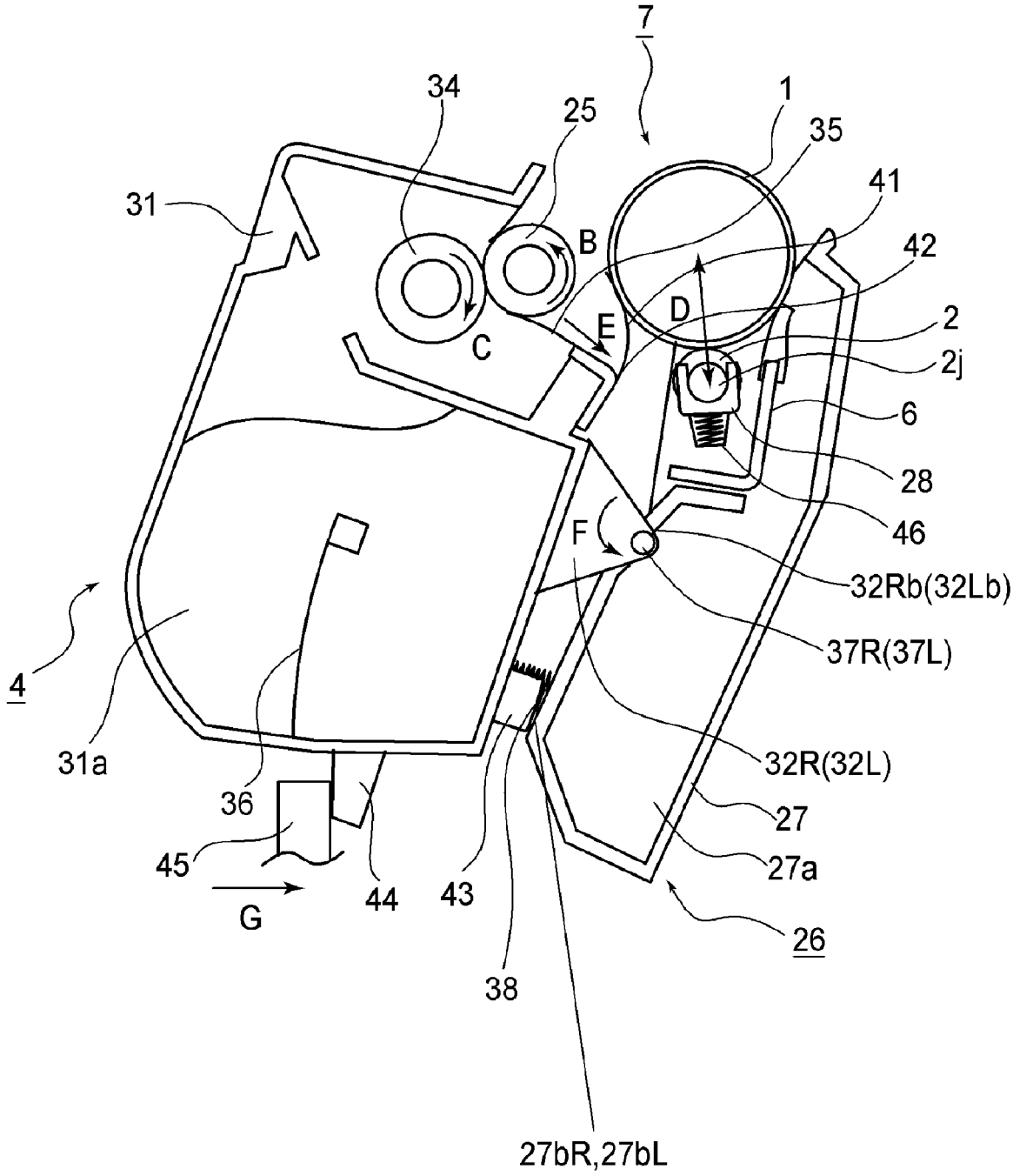
FIG. 3 is a schematic sectional view of the cartridge during separation of a developing roller from a photosensitive drum.

FIG. 3 is a schematic sectional view of the cartridge 7 in a mounted state to the image forming apparatus main assembly 100*a*, wherein the photosensitive drum 1 and the developing roller 25 are separated from each other. In this separation state, a receiving portion 44 provided to the developing unit 4 receives a force, of a separating mechanism 45 provided to the image forming apparatus main assembly 100*a*, exerted in the direction indicated by an arrow G, so that the developing unit 4 is rotated about a shaft 37 in the direction indicated by an arrow F, thus being held.

Figure 4:
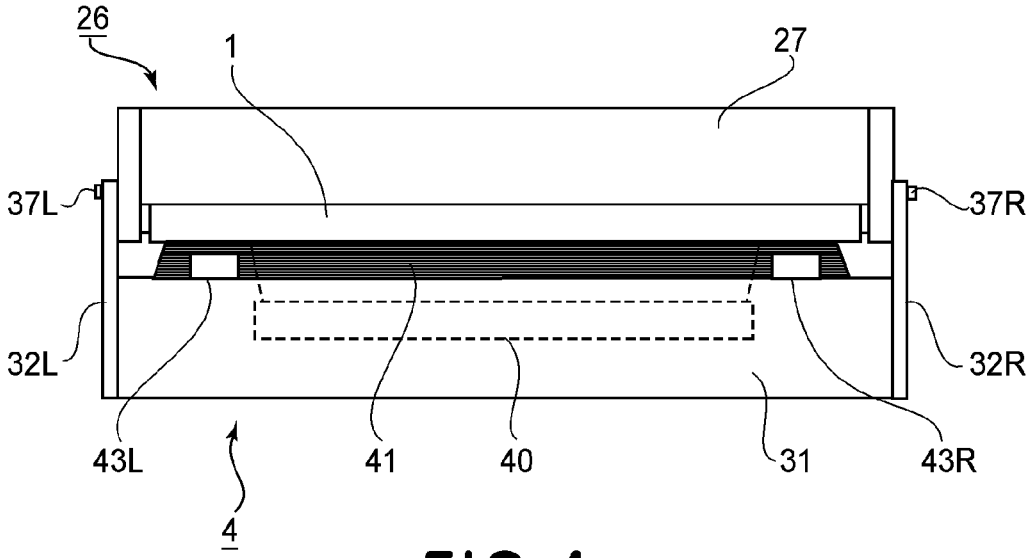
FIG. 4 is a bottom view of the cartridge.

FIG. 4 is a schematic view of the cartridge 7 in the separation state as seen from an exposure portion side of the apparatus main assembly. At a part of a portion of the developing device frame 31 opposite from the separation portion with respect to a swing shaft, first contact portions 43 (43R, 43L) for regulating a swingable range of the developing unit 4 are provided. These first contact portions 43 (43R, 43L) are, as shown in FIG. 4, provided at positions avoiding an exposure range of the exposure portion 40 (i.e., outside of the optical path) so as not to obstruct an exposure optical path for the photosensitive drum 1 during the image formation and provided within a contact range between the sheet member 41 and the photosensitive drum 1 with respect to an axial direction of the photosensitive drum 1.

The first contact portions 43 (43R and 43L) contact second contact portions 27 (27*b*R, 27*b*L) provided at both longitudinal end portions of the cleaning device frame 27, so that the swingable range of the developing unit 4 is regulated. Thus, even during the separation of the developing roller 25, it is possible to always bring the sheet member 41 into contact with the photosensitive drum 1. As a result, turning-up of the sheet member 41 which can occur in the case where the process cartridge is subjected to impact during the transportation or when the developing roller 25 is excessively moved away from the photosensitive drum 1 can be prevented, so that scattering of the confined toner into the image forming apparatus main assembly.

In this embodiment, the first contact portions 43 project from the developing device frame 31 and the second contact portions 27 are on the same surface as the surface of the cleaning device frame 27. However, this constitution may be reversed and may also be modified so that both of the first contact portions 43 and the second contact portions 27 are configured to project from an associated frame.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 138248/2008 filed May 27, 2008, which is hereby incorporated by reference.

What is claimed is:

1. A process cartridge detachably mountable to a main assembly of an image forming apparatus, comprising:

a photosensitive member unit including an electrophotographic photosensitive member; and a developing unit including a developing roller for carrying developer so as to develop a latent image formed on the electrophotographic photosensitive member and a sheet member which contacts the electrophotographic photosensitive member at one lateral end thereof and is fixed to said developing unit at the other lateral end thereof, said developing unit being swingable with respect to said photosensitive member unit so as to establish contact and separation between the developing roller and the electrophotographic photosensitive member, wherein when the developing roller is separated from the electrophotographic photosensitive member, a first contact portion provided to said developing unit and a second contact portion provided to said photosensitive member unit contact each other so as to prevent separation of the sheet member from the electrophotographic photosensitive member.

2. A cartridge according to claim 1, wherein at least one of the first contact portion and the second contact portion projects toward an associated contact portion.

3. A cartridge according to claim 1, wherein the main assembly of the image forming apparatus includes an exposure portion for exposing the electrophotographic photosensitive member to light, and wherein in a state in which said process cartridge is mounted to the main assembly of the image forming apparatus, the first contact portion and the second contact portion are provided outside an optical path for the exposure with respect to a longitudinal direction of the electrophotographic photosensitive member.

4. A cartridge according to claim 1, wherein the first contact portion and the second contact portion are provided with a range in which the sheet member contacts the electrophotographic photosensitive member with respect to a longitudinal direction of the electrophotographic photosensitive member.

5. A cartridge according to claim 1, wherein each of the first contact portion and the second contact portion is provided at both end portions of said process cartridge with respect to a longitudinal direction of the electrophotographic photosensitive member.

6. A cartridge according to claim 1, wherein the first contact portion and the second contact portion are located opposite from the sheet member with respect to a swing shaft for said developing unit.

7. A cartridge according to claim 1, wherein the main assembly of the image forming apparatus includes an exposure portion for exposing the electrophotographic photosensitive member to light so as to form an electrostatic latent image on the electrophotographic photosensitive member, and wherein in a state in which said process cartridge is mounted to the main assembly of the image forming apparatus, the sheet member is located below the developing roller and above the exposure portion.

* * * * *